United States Patent [19]

Gibbs

[11] 4,339,002

[45] Jul. 13, 1982

[54] SEA BUOY DISCHARGE MANIFOLD SYSTEM

[75] Inventor: Max A. Gibbs, Duncan, Okla.

[73] Assignee: Halliburton Company, Duncan, Okla.

[21] Appl. No.: 65,164

[22] Filed: Aug. 9, 1979

[51] Int. Cl.[3] ..... E21B 43/013

[52] U.S. Cl. ..... 166/355; 141/387; 166/366; 285/132; 285/DIG. 22

[58] Field of Search ..... 166/353, 354, 350, 311, 166/314, 52, 366, 75 R; 285/132, DIG. 21, DIG. 22; 141/387

[56] References Cited

U.S. PATENT DOCUMENTS

| | | | |
|---|---|---|---|
| 2,818,891 | 1/1958 | Loeser | 137/236 X |
| 3,408,971 | 11/1968 | Mott | 9/8 P |
| 3,602,302 | 8/1971 | Kluth | 166/366 X |
| 3,683,669 | 1/1972 | True et al. | 166/75 X |
| 3,698,474 | 10/1972 | Rowley | 166/90 |
| 3,708,811 | 1/1973 | Flory | 9/8 P |
| 3,782,458 | 1/1974 | Slack | 166/355 |
| 3,894,567 | 7/1975 | Mott et al. | 137/263 X |
| 4,125,162 | 11/1978 | Groves, Sr. et al. | 166/75 R |
| 4,188,050 | 2/1980 | Lochte | 285/DIG. 21 X |

*Primary Examiner*—James A. Leppink

*Attorney, Agent, or Firm*—John H. Tregoning; James R. Duzan; Lucian Wayne Beavers

[57] ABSTRACT

A discharge manifold system is provided for connecting a pressurized fluid discharge from a floating vessel to an offshore well. A floating buoy is anchored at a distance away from the offshore platform. A first manifold is located on the floating buoy and includes an inlet and first and second outlets. A second manifold is located on the production platform adjacent the offshore well and includes first and second inlets and an outlet which is connected to the offshore well. First and second valves are connected to the outlets of the first manifold. Third and fourth valves are connected to the inlets of the second manifold. A first flexible intermediate conduit is connected between the first and third valves and a second flexible intermediate conduit is connected between the second and fourth valves. The first, second, third and fourth valves, and the first and second flexible intermediate conduits comprise a means for providing selectable redundant fluid communication between the floating vessel and the offshore well. A high pressure treating fluid discharge from the floating vessel is directed to the inlet of the first manifold through a flexible discharge conduit connected to the fluid conducting swivel. This allows the floating vessel to rotate 360° about the floating buoy during the pumping operations.

31 Claims, 9 Drawing Figures

SEA BUOY DISCHARGE MANIFOLD SYSTEM

This invention relates generally to discharge manifold systems for connecting a pressurized fluid discharge of a floating vessel to an offshore well by means of flexible conduits, and more particularly, but not by way of limitation, to such manifold systems including a floating buoy with flexible conduits connecting the floating buoy to the floating vessel and to the offshore well.

Land based oil and gas wells are often stimulated by pumping treating fluids under high pressure into the well to treat the producing underground formations of the well. The equipment used for performing such stimulation operations on land includes a high pressure pump mounted on a truck or on a skid, with high pressure steel piping connected between the pump discharge and the oil or gas well so that high pressure treating fluid is pumped into the well.

Such stimulation operations, however, are not so easily accomplished on offshore wells. At times, conventional land based type pumping equipment on skids has been lifted into place on an offshore platform adjacent the offshore well, and connected thereto by conventional steel pipe. Such a manner of operation is, however, generally not feasible because of the very limited work space available on an offshore platform. There typically is not enough available room to permit the placement of skid mounted pumping units on the offshore platform.

Skid mounted pumping units have also been placed on floating work boats. The work boats were then moved to a location adjacent the offshore platform and tied thereto by conventional mooring lines. The discharge of the pump was then connected to the offshore well by conventional steel piping with swiveled pipe joint connections located therein. This manner of operation has also proved unsatisfactory for several reasons.

The difficulties with using conventional steel piping between the pump discharge located on the floating vessel and the well head on the offshore platform generally stems from the unpredictable and often severe environmental conditions present offshore. The handling and connection of conventional steel discharge lines between a floating vessel and an offshore platform is slow, dangerous and the hook-up made is often not reliable. Pressure integrity is often compromised by pipe unions being loosened in the constant swaying and twisting caused by wave motion.

Additionally, the smaller steel pipe sizes which can be generally handled by the available lifting equipment on the offshore platform are not mechanically strong enough to withstand the high tensile and bending loads encountered. Also, there are very high power losses between the pump and the well head if small line sizes are used. Fluid velocities become very high and when the treatment fluid includes proppants, the proppants will very quickly erode the pipe, possibly causing failure within the time span of a single treatment job.

At the very best, connection of a floating vessel to an offshore platform by the use of conventional steel pipe is limited to very calm sea conditions, both for rigging up and pumping the treatment fluid.

Furthermore, the position of the floating vessel relative to the offshore platform is restricted to the mooring locations available on the offshore platform. Depending upon the direction of the wind, the floating vessel may or may not be favorably oriented relative to the oncoming saves.

A final difficulty present in using conventional steel pipe to connect the floating vessel to the offshore platform is the unavailability of emergency disconnect or breakaway connections. If a mooring line between the floating vessel and the offshore platform breaks, the floating vessel will often drift away and the steel pipe connecting the skid mounted pumping units to the well head will drag the skids across the deck of the floating vessel causing serious damage to both person and property.

The prior art also includes systems wherein a floating vessel such as a tanker has been connected to a subsea well, or to a collection point for oil from the well, through a flexible discharge line connected to a fluid conducting swivel means located on a floating buoy, and then through an intermediate flexible conduit connected between the swivel means and the subsea well. These systems, however, are designed for much lower pressures (e.g. 1000 psi) than are involved in the stimulation operations (e.g. 10,000 psi), and it is believed that none of those prior art systems have included appropriate valving and multiple lines to provide selectable redundant fluid communication between the floating vessel and the well.

The present invention provides both apparatus and methods for rapidly, safely and conveniently connecting a high pressure fluid discharge from a floating vessel to an offshore well. This is accomplished by a discharge manifold system including a plurality of hydraulically parallel flexible conduits connected between the high pressure fluid discharge of the floating vessel and the offshore well. Located at each end of each flexible conduit are valve means which are in turn connected to manifold means so that all of the flexible conduits are communicated with each other.

This system provides selectable redundant fluid communication between the fluid discharge of the floating vessel and the offshore well.

Preferably, the manifold means at one end of the flexible conduits is mounted on a floating buoy. The manifold means is communicated with a fluid conducting swivel means supported on the buoy.

The high pressure fluid discharge of the floating vessel is connected to the fluid conducting swivel means on the floating buoy by another flexible conduit means. Thus, the floating vessel is able to freely rotate 360° about the floating buoy during the pumping operation without affecting the flexible conduits connected between the floating buoy and the offshore platform.

Additional desirable features include a plurality of selectively floodable compartments located on the floating buoy and buoyancy adjustment means for selectively filling and emptying the compartments to vary the buoyancy of the buoy. A powered winch means supported by the buoy is attached to an anchor, which is controlled by remote control means so that the buoyancy of the buoy and its location relative to the surface of the water may be remotely controlled.

Snap-in connectors are provided between the floating vessel and the floating buoy, and between the floating buoy and the offshore well, so that connections may be rapidly made between the various components.

Each of the valve means preferably includes a power operator and the valve means also are actuated by remote control means located on either the floating vessel or the offshore platform adjacent the offshore well.

A plurality of spaced flotation collars are attached to the flexible conduits between the floating buoy and the offshore well, to support said conduits above the ocean floor. The flotation collars include a selectively floodable compartment for varying the buoyancy of the flotation collars.

In addition to being useful for offshore stimulation operations, the present invention is useful for pumping treating fluids into a relief well located adjacent a wild well experiencing a blow-out, so that the wild well may be killed by the relief well pumping.

Numerous features and advantages of the present invention will be readily apparent to those skilled in the art upon a reading of the description of preferred embodiments which follows when taken in conjunction with the accompanying drawings.

FIG. 3 is a schematic illustration of the various apparatus of FIG. 1.

FIG. 9 is a schematic illustration of a discharge manifold and intensifier system having a pump located on the offshore production platform and supplying both high pressure treating fluid and high pressure power fluid from the floating vessel to the offshore platform so that the pressure of the treatment fluid is increased by the pump means on the offshore production platform.

Figure 1:
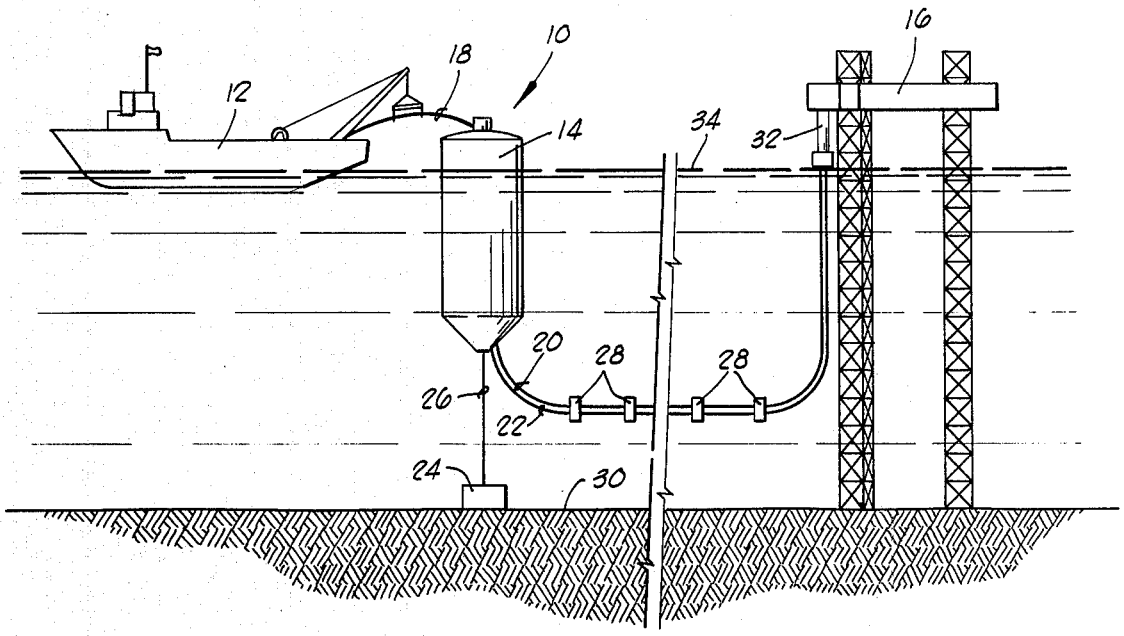
FIG. 1 is a schematic elevation view of a floating vessel and an offshore platform with the discharge manifold system of the present invention connected therebetween.
Figure 2:
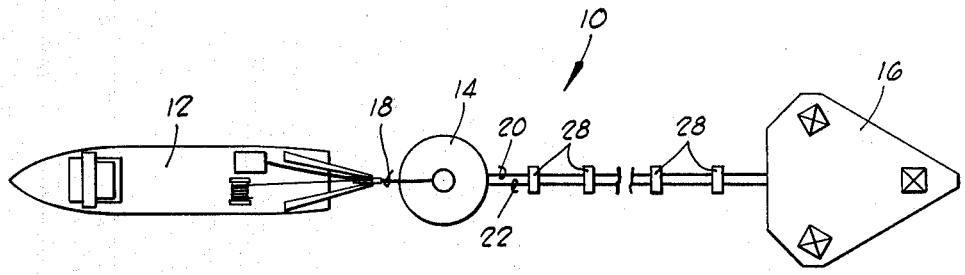
FIG. 2 is a plan view of the apparatus shown in FIG. 1.

Referring now to the drawings and particularly to FIGS. 1, 2 and 3, a sea buoy discharge manifold system is shown and generally designated by the numeral 10.

Illustrated in FIGS. 1 and 2, are a floating vessel or work boat 12, a floating buoy 14, and an offshore platform 16 which is located adjacent an offshore well.

In a preferred embodiment, buoy 14 is generally cylindrical in shape having a diameter on the order of 10 feet and a length on the order of 50 feet.

Connected between floating vessel 12 and floating buoy 14 is a flexible discharge conduit means 18. Connected between floating buoy 14 and offshore platform 16 are first and second flexible intermediate conduits 20 and 22, respectively.

FIG. 1 shows a small crane from the floating vessel 12 holding up the discharge conduit 18. Alternatively, if floating vessel 12 is located close enough to floating buoy 14, there is no need for intermediate support of that portion of the discharge conduit 18 spanning floating vessel 12 and floating buoy 14, but rather, a loose portion of the discharge conduit 18 may merely be laid on the deck of floating vessel 12. Another alternative arrangement merely allows the discharge conduit 18 to droop between floating vessel 12 and floating buoy 14 so that a middle portion of discharge conduit 18 is located below the ocean surface.

The various flexible conduits referred to in this application are preferably 10,000 psi working pressure steel reinforced flexible pipes having suitable non-metallic liners and outer coverings such as are manufactured by Coflexip and Services, Inc. of Houston, Texas, under the trademark "Coflexip".

The floating buoy 14 is connected to an anchor 24 by anchor line 26. Flotation means including a plurality of flotation collars 28 are attached to flexible intermediate conduits 20 and 22 along a length thereof for supporting said conduits above an ocean floor 30.

The ends of intermediate conduits 20 and 22 adjacent offshore platform 16 are connected to a riser pipe 32 at a point close to the surface 34 of the ocean.

Referring now to FIG. 3, the various components shown in FIGS. 1 and 2 are illustrated in schematic fashion in much greater detail.

The floating vessel 12 is a work boat having first and second skid mounted pumping units 36 and 38 located thereon. The suction side of pumping units 36 and 38 receive treating fluid from a source 40 also located upon floating vessel 12. The discharge end of first and second pumps 36 and 38, each of which may be generally referred to as a pressurized fluid discharge, preferably have mounted thereon conventional swivel pipe connections 42 and 44.

First and second flexible discharge conduits 46 and 48, respectively, comprise the flexible discharge conduit means 18. Discharge conduits 46 and 48 are connected to the pressurized fluid discharges of pumps 36 and 38 at swivel joints 42 and 44, respectively.

The piping components located on floating buoy 14 may be described as follows. A first manifold means 50 is supported by buoy 14 and includes an inlet 52 and first and second outlets 54 and 56, respectively. Each of the outlets 54 and 56 are in fluid communication with inlet 52.

A fluid conducting swivel means 58 is connected to inlet 52 of first manifold means 50. The fluid conducting swivel means 58 is preferably constructed similar to the structure disclosed in U.S. Pat. No. 3,967,841 to Kendrick, et al, the details of which are incorporated herein by reference.

The second end of flexible discharge conduit means 18, adjacent floating buoy 14, is connected to fluid conducting swivel means 58 by a connecting means generally designated by the numeral 60, so that discharge conduit means 18 may pivot about first manifold means 50.

Connecting means 60 includes a second manifold means 62 having first and second inlets 64 and 66 and an outlet 68. The outlet 68 is connected to fluid conducting swivel means 58.

Extending from first and second inlets 64 and 66, are first and second drop down pipe members 70 and 72.

The second end of first flexible discharge conduit 46 is connected to first drop down pipe member 70, and accordingly connected therethrough to first inlet 62, by a first snap-in connector 74. Snap-in connector 74 includes first and second connector portions 71 and 73. Snap-in connector 74 is preferably constructed in a manner similar to the connector illustrated in FIGS. 2 and 3 of U.S. Pat. No. 3,318,382 to Holden, et al, the details of which are incorporated herein by reference.

Similarly, the second end of second flexible discharge conduit 48 is connected to second drop down pipe member 72, and accordingly therethrough to second inlet 66, by a second snap-in connector 75.

Connected to first and second outlets 54 and 56 of first manifold means 50 are first and second valve means 76 and 78. Valves 76 and 78 are preferably plug valves of the type shown in U.S. Pat. No. 2,813,695 to Stogner. Connected to first and second valve means 76 and 78 are first and second pipe spools 80 and 82, respectively.

First flexible intermediate conduit 20 has a first end 84 connected to first pipe spool 80 and accordingly therethrough to first valve means 76. Second flexible intermediate conduit 22 has a first end 86 connected to second pipe spool 82 and accordingly therethrough to second valve means 78.

The piping system located on offshore production platform 16 may be described as follows. A third manifold means 88, includes first and second inlets 90 and 92, respectively, and an outlet 94. Each of the inlets 90 and 92 are in fluid communication with outlet 94.

Third and fourth valve means 96 and 98 are connected to first and second inlets 90 and 92, respectively.

The second end of first flexible intermediate conduit 20 is connected to third valve means 96 through a snap-in connector 100 and a first adapter 102. Adaptor 102 connects third valve means 96 to one of the portions of the snap-in connector 100.

Similarly, the second end of second flexible intermediate conduit 22 is connected to fourth valve means 98 through a snap-in connector 104 and a second adaptor 106.

Connected to outlet 94 of third manifold means 88 is a check valve 108. Riser pipe 32 connects check valve 108 to a well head valve 112 adjacent well head 114.

In operation of the sea buoy discharge manifold system 10, treating fluid from source 40 is pumped by first and second pumps 36 and 38 through flexible discharge conduits 46 and 48 into second manifold means 62, then through fluid conducting swivel means 58 into first manifold means 50, then through first and second valve means 76 and 78, through first and second intermediate conduits 20 and 22, and through third and fourth valve means 96 and 98 into third manifold means 88, then through check valve 108, riser pipe 32 and well head valve 112 into well head 114 which directs the treating fluid down hole into the well and into the subsurface formation thereof to be treated by the treating fluid.

The first, second, third and fourth valve means 76, 78, 96 and 98, and first and second flexible intermediate conduits 20 and 22 comprise a means for providing selectable redundant fluid communication between first manifold means 50 and the offshore well represented by well head 114.

It is desirable that such selectable redundant fluid communication be provided when performing a stimulation operation on the offshore well 114 for the following reasons. The time available to perform a stimulation operation on an offshore well is often limited due to changing environmental conditions and additionally, it is desirable not to have to discontinue the stimulation operation due to the failure of one of the intermediate lines prior to the time the stimulation operation would normally be terminated. The use of first and second intermediate flexible conduits 20 and 22 provide redundancy in the event one of the hoses should fail during the stimulation operation. Additionally, increased flow capacity for the treatment fluid is provided.

Preferably, during normal stimulation operations, the treating fluid will be pumped through both the first and second flexible intermediate conduits 20 and 22. If one of the first and second flexible intermediate conduits 20 and 22 fails during the pumping operation, the appropriate valve means connected to the ends of the intermediate conduit which fails may be closed so as to direct the entire flow of treatment fluid through the other one of the flexible intermediate conduits. It is therefore necessary to have sufficient pumping power in the first and second pumps 36 and 38 so as to be able to force the desired flow rate of treatment fluid through a single one of the intermediate flexible conduits 20 and 22.

After the stimulation operation has been performed, it is sometimes necessary to flow the treating fluid back out of the well 114 prior to conducting further operations on the well.

With land-based wells, the flow back problem is generally insignificant, because the treating fluid can often be dumped at a convenient waste disposal location. On offshore wells, however, disposal of the flow back of treating fluid often presents a more serious problem due to environment considerations.

Disposal of such flow back treating fluid has previously been accomplished by burning the waste treating fluid in a burner mounted on a boat connected to the well 114 through a connecting pipeline.

By the present invention, a much safer and superior arrangement may be provided by locating such a burner means 116 on floating buoy 14. A flexible waste return conduit means 118 is connected to a flow back valve 120 on well head 114 so that the treating fluid may be flowed back from well 114 through waste return conduit 118 to the burner 116 located on buoy 14.

The waste return conduit 118 is preferably connected to the flotation collars 28 (see FIG. 1) along with first and second intermediate conduits 20 and 22, so that the flexible waste return conduit 118 is supported by flotation collars 28.

Preferably, the first, second, third and fourth valve means 76, 78, 96 and 98, respectively, are all equipped with power operators 122. Power operators 122 are pneumatic operators. Equivalent power operators would include hydraulic and electrically powered operators.

The power operators 122 attached to first and second valve means 76 and 78, on floating buoy 14, are connected to a compressed air supply 124, which is also located on floating buoy 14, by compressed air lines 126 and 128.

The power operators 122 of third and fourth valve means 96 and 98, located on offshore production platform 16, are connected to a compressed air supply 130, which is also located on offshore production platform 16, by compressed air lines 140 and 142.

Each of the compressed air supplies 124 and 130 are represented only in a very schematic fashion, and are considered to include both a source of compressed air and all the necessary valving to direct the compressed air through the mentioned compressed air supply lines to the desired valve means.

The direction of compressed air to the various valve means from the compressed air supplies is controlled by a remote control means for actuating the power operators 122 in response to a command signal from either floating vessel 12 or offshore production platform 16.

The remote control means includes first and second radio signal transmittors 140 and 142, located on floating vessel 12 and offshore production platform 16, respectively. First and second radio receivers 144 and 146, are located on floating buoy 14 and offshore production platform 16, respectively, for receiving command radio signals from either of the radio transmittors 140 or 142. The radio type remote control means can be replaced by equivalent tether type remote control means.

In response to a command signal, the radio receivers 144 and 146 transmit electrical signals through electrical connecting means 148 and 150, to compressed air supplies 124 and 130, respectively, in response to which the compressed air supplies 124 and 130 direct pneumatic signals through the appropriate compressed air line to the valve operator 122 of the valve which it is desired to open or close.

Similarly, each of the snap-in connectors 74, 76, 100 and 104, include pneumatically operated release means 152 for releasing said snap-in connectors. The release means 152 of snap-in connectors 74 and 76 are connected to compressed air supply 124 of floating buoy 14 by a compressed air line 154.

Pneumatic release means 152 of snap-in connectors 100 and 104 are connected to compressed air supply 130 of offshore production platform 16 by compressed air line 156. The direction of air through compressed air lines 154 and 156 is controlled by compressed air supplies 124 and 130 in response to command signals from radio receivers 144, and 146, respectively.

Floating buoy 14 includes certain additional equipment to assist in its positioning. An anchor means generally designated by the numeral 158 is connected to floating buoy 14 for anchoring the same to the ocean floor 30. Anchor means 158 includes a winch 160 connected to anchor line 26. A tension load on anchor line 26 may be varied by reeling anchor line 26 onto winch means 160. Winch means 160 is powered by electric motor 162 which receives power from a power source 164 through electrical connecting means 166.

The power source 164 also powers compressed air supply 124 and radio receiver 144 through electrical connecting means 168 and 170, respectively.

Floating buoy 14 also includes a plurality of selectively floodable compartments 172, 174, 176 and 178. The selectively floodable compartments 172, 174, 176 and 178 are connected to compressed air supply 124 by compressed air lines 180, 182, 184 and 186, respectively. Valve means 188, 190, 192 and 194 are connected to floodable compartments 172, 174, 176 and 178, respectively, to permit the same to be flooded. The valves 188, 190, 192 and 194 are connected to radio receiver 144 by electrical connecting means 196 which transmits a signal to said valves to appropriately open and close them.

Thus, the selectively floodable compartments 172, 174, 176 and 178, valves 188, 190, 192 and 194, compressed air supply 124 and radio receiver 144, along with the various compressed air lines and electrical connections therebetween, provide a means for selectively filling and emptying said compartments 172, 174, 176 and 178 to vary the buoyancy of floating buoy 14. All these apparatus may be controlled by radio signals received by radio receiver 144.

Preferably, the floating buoy 14, anchor means 158 and floodable compartments 172, 174, 176 and 178 are so constructed that when said floodable compartments 172, 174, 176 and 178 are completely flooded, said winch means 158 is capable of pulling buoy 14 completely under the surface 34 of the ocean so that the floating buoy 14 may be protected from severe environmental conditions sometimes present on the ocean surface 34.

The various electrical components located on floating buoy 14 should be located in waterproof compartments or protected in some other manner from the environment.

The sea buoy discharge manifold system 10 is installed in the following manner. First the anchor 24 for floating buoy 14 is dropped from directly above the desired location of the buoy 14. The anchor line 26 attached to anchor 24 should have a retrieving buoy (not shown) attached to its upper end so its location can be identified. After the anchor 24 is in place, the retrieving buoy is picked up and the anchor line 26 is reeved into the winch means 160. This occurs before the floating buoy 14 has been launched from the launching boat (not shown). The appropriate valves connected to the compartments 172, 174, 176 and 178 of floating buoy 14 are then properly arranged so as to allow the desired submergence of floating buoy 14. Then the floating buoy 14 is launched and through use of the winch means 126, the buoy 14 is under control after launching and during the submerging procedure.

When flooding of the desired compartments is completed, final tensioning of the anchor line 26 is accomplished by remote control as previously described.

When it is desired to retrieve the floating buoy 14, the anchor line 26 may be slacked off and the compartments 172, 174, 176 and 178 may be blown empty by compressed air from compressed air supply 124.

After the floating buoy 14 is launched and submerged to a position similar to that shown in FIG. 1, the first and second flexible intermediate conduits 20 and 22 are laid between the floating buoy 14 and the offshore production platform 16. Their ends are then connected to the appropriate manifold means at each end. Then, by selectively flooding the floodable compartments of the flotation collars 28, the intermediate conduits 20 and 22 may be submerged to the desired depth. Preferably, the collars 28 retain about 70% positive buoyancy of the weight of the conduits. This gives a relatively flat configuration to the middle portion of the catenary formed by conduits 20 and 22 approximately as illustrated in FIG. 1.

It is also possible to submerge intermediate lines 20 and 22 all the way to the ocean floor 30, but it is generally preferable not to do so because of the high cost of the flexible lines and the increased difficulty in handling them as the length of the lines increases.

Preferably, the floating buoy 14 is anchored at a distance away from offshore platform 16 greater than a length of floating vessel 12. The intermediate conduits 20 and 22 are then submerged to a depth below a bottom of floating vessel 12 so that floating vessel 12 may rotate 360° about floating buoy 14 to position itself most favorably relative to oncoming seas during the pumping operations.

Figure 4:
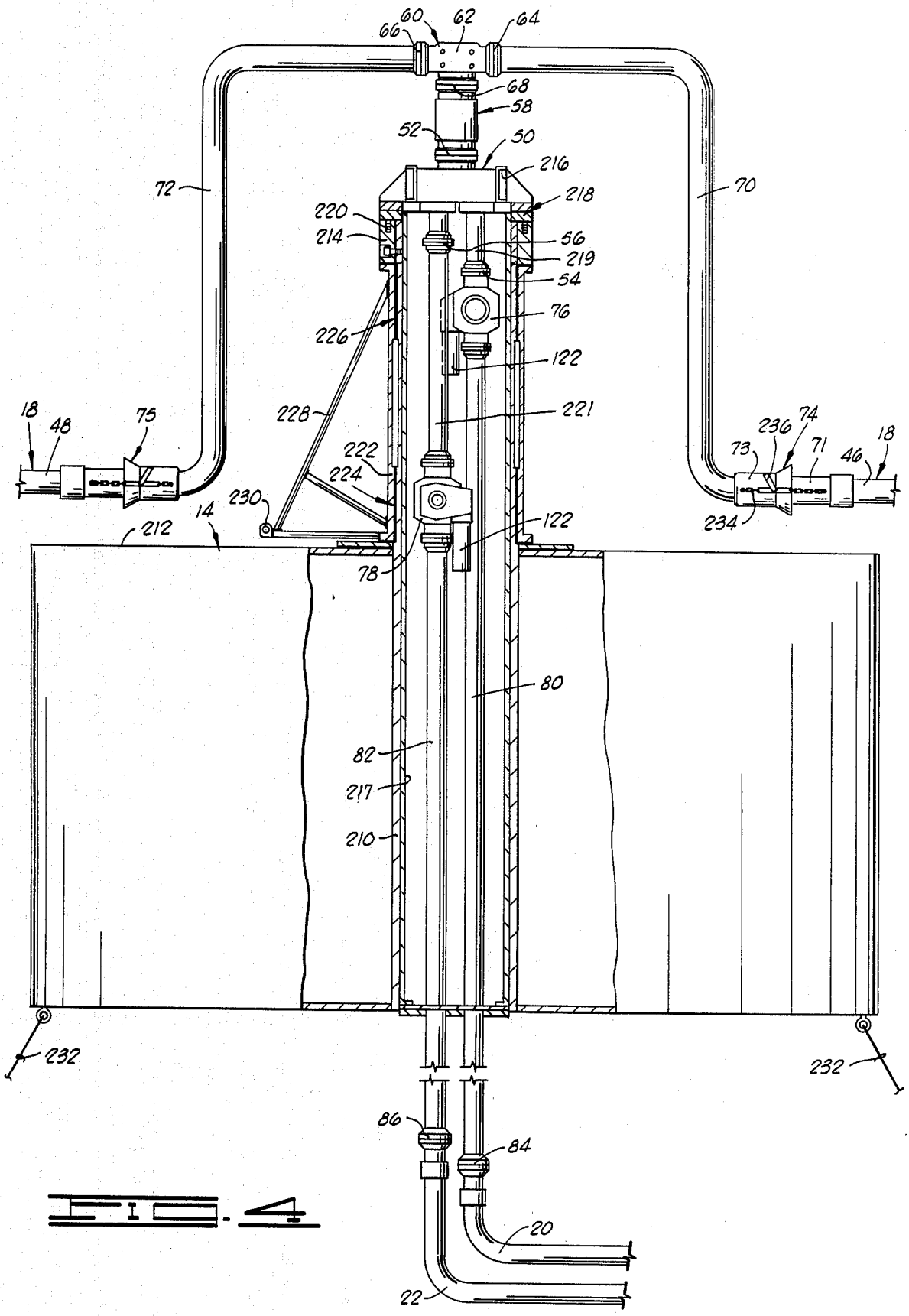
FIG. 4 is a elevational partly sectioned view of one embodiment of the floating buoy and components attached directly thereto.
Figure 5:
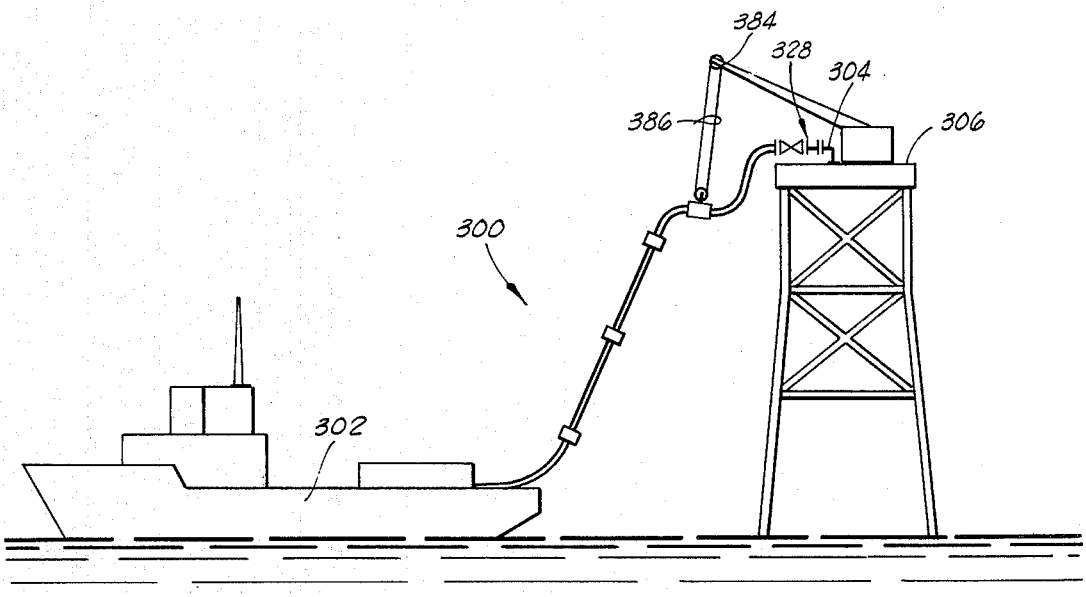

Referring now to FIG. 4, one specific embodiment of the floating buoy 14 is there illustrated, with the various components of FIG. 4 designated by the same numerals as used in FIG. 3.

The floating buoy 14 is donut-shaped and includes a central pipe member 210 which extends a distance above an upper surface 212 of buoy 14. At the upper end of central pipe member 210 is located a radially outward extending flange member 214.

The first manifold means 50 is supported by a structural member 216 having a flange 218 thereon for engaging flange 214.

Under normal operating conditions, the flange 218 is preferably bolted to the flange 214 by a plurality of suitable bolt means 220. If, however, the swivel means 58 should seize up, the bolts 220 may be removed, thereby allowing a more limited but still useful relative rotation between flanges 218 and 214 due to the torsional flexibility of manifold 50 and the pipe spools 80 and 82 extending downward therefrom.

Extending downward from flange 218 is a cartridge shell 217 for protecting the components contained therein during assembly of the various piping components with the floating buoy 14.

The manifold means 50 of FIG. 4 includes first and second downwardly extending intermediate spools 219 and 221.

Concentrically located around the upper end of central pipe member 210 is a cylindrical mooring frame 222 which rotates about central pipe member 210 upon bushings 224 and 226. Extending radially outward from mooring frame 222 is a mooring bracket 228 which has an eye 230 attached at the radially outward end thereof. The floating vessel 10 may be moored to the floating buoy 14 by a mooring line (not shown) connected to eye 230.

The floating buoy 14 is anchored to the ocean floor 30 by a plurality of anchor lines 232.

It should be noted, that the buoy 14 illustrated in FIG. 4, along with central pipe member 210, mooring frame 222 and mooring bracket 228, are a part of the prior art. Such a buoy has previously been used with a single riser pipe located therein for use in loading and unloading crude oil and similar products from tankers.

FIG. 4 also shows a more detailed view of snap-in connectors 74 and 75. For example, snap-in connector 74 includes first and second connector portions 71 and 73. This provides a capability of connecting floating vessel 12 to floating buoy 14 in the following manner. First a guideline (not shown) is passed over from floating buoy 14 to the floating vessel 12 and connected to an end of the flexible discharge conduit 46. Then the guideline is winched toward floating buoy 14, thereby pulling the conduit 46 from the floating vessel 12 to the floating buoy 14 to pull the two portions 71 and 73 of the snap-in connector 74 together so that a quick snap-in connection is made. The guideline and winch for this operation are represented in FIG. 4 by guideline means 234 and hand powered winch means 236.

Another feature illustrated in FIG. 4 is the manner of connection of the various piping components. As is shown, for example, at the connection between inlet 52 of manifold means 50 and the bottom end of fluid conducting swivel means 58, there are two flanges butted up together. Preferably these flanges are the type which are connected together by an outer collar or coupling fitting over the edges of both flanges to squeeze the flanges together. The flanges could also be bolted flanges. It is preferable, however, that the connections be non-rotating type connections, i.e. they should not be threaded, because of the problems of loosening of threaded connections due to constant wave motion.

Figure 5:
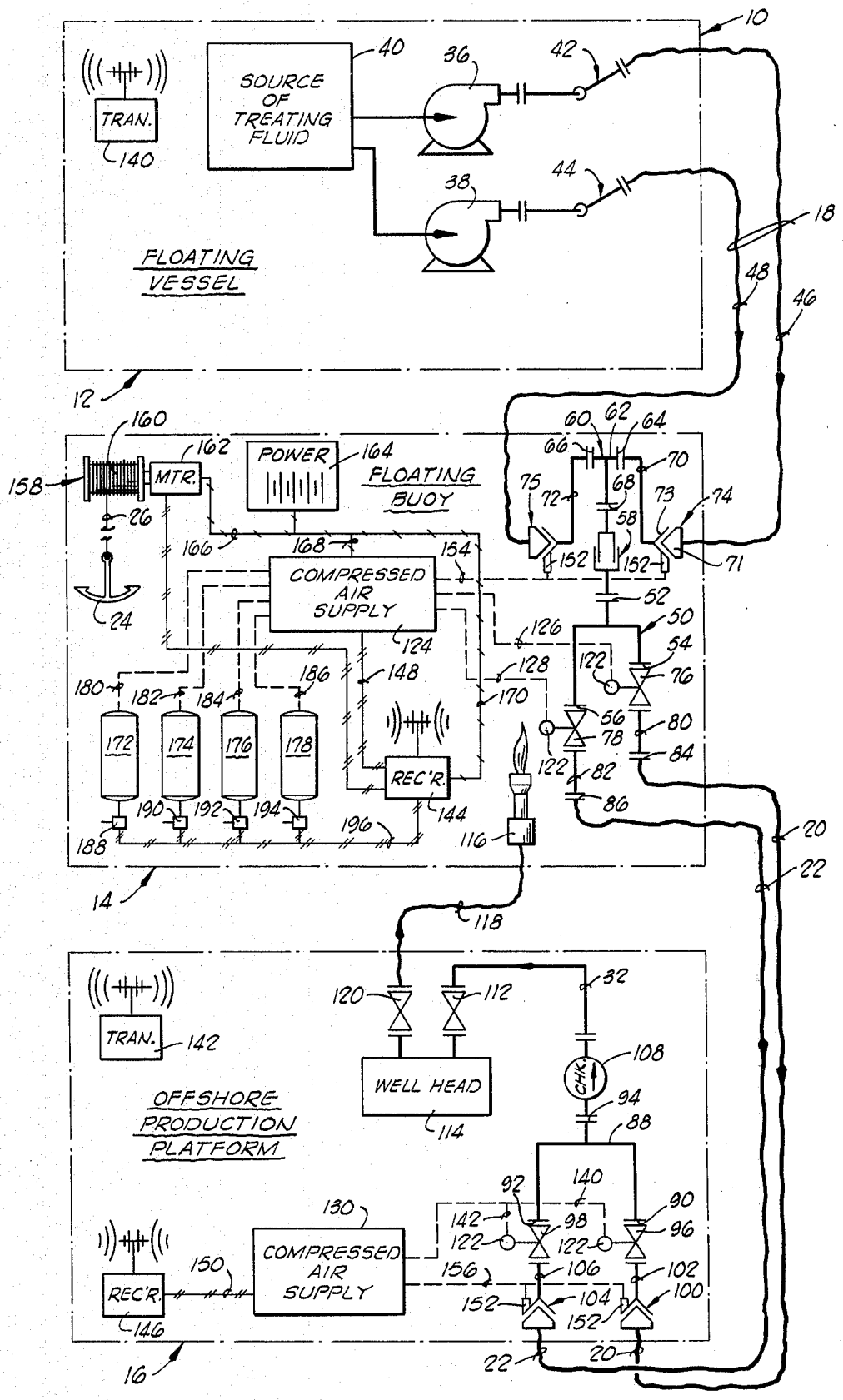
FIG. 5 is a schematic elevation view of a floating vessel and an offshore platform with a discharge manifold system connected therebetween which does not include a floating buoy.

Referring now to FIG. 5, an elevation view is shown of an alternative embodiment of the present invention. In FIG. 5, a discharge manifold system is shown and generally designated by the numeral 300. A floating vessel or work boat 302, similar to the floating vessel 12, is in fluid communication with an offshore well 304 adjacent offshore platform 306 through a plurality of intermediate flexible conduits of discharge manifold system 300. A floating buoy such as buoy 14 of FIG. 1 is not required with the discharge manifold system 300.

Figure 6:
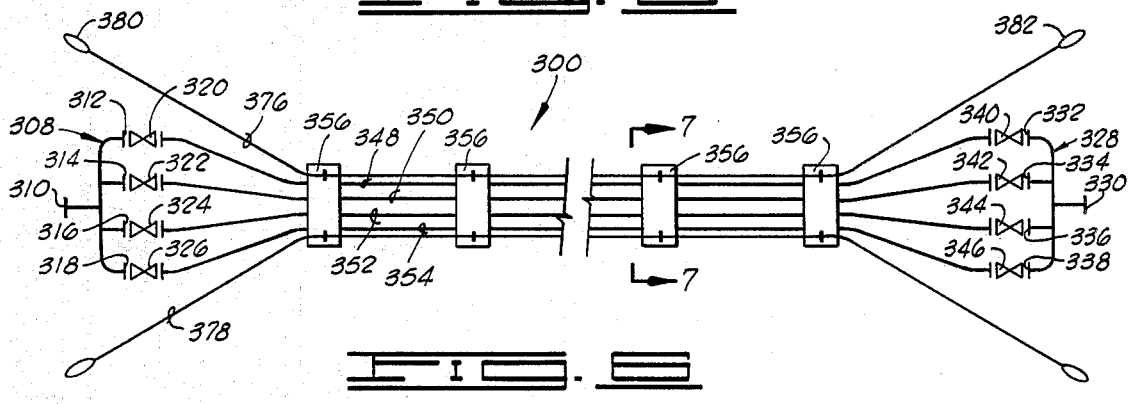
FIG. 6 is a plan view of a discharge manifold system for use without a floating buoy, such as the discharge manifold system shown in FIG. 5.

The discharge manifold system 300 is best illustrated in FIG. 6. Discharge manifold system 300 includes a first manifold means 308 which has an inlet 310 and first, second, third and fourth outlets 312, 314, 316 and 318, respectively. The outlets 312, 314, 316 and 318 are all in fluid communication with inlet 310.

First, second, third and fourth valve means 320, 322, 324 and 326 are connected to first, second, third and fourth outlets 312, 314, 316 and 318, respectively.

Discharge manifold system 300 further includes a second manifold means 328. Second manifold means 328 includes an outlet 330 adapted for connection to offshore well 304. Second manifold means 328 further includes first, second, third and fourth inlets 332, 334, 336 and 338, respectively, all of which are in fluid communication with outlet 330.

Fifth, sixth, seventh and eighth valve means 340, 342, 344, and 346, respectively, are connected to first, second, third and fourth inlets 332, 334, 336 and 338, respectively.

A first flexible conduit 348 is connected between first and fifth valve means 320 and 340. A second flexible conduit 350 is connected between second and sixth valve means 332 and 342. A third flexible conduit 352 is connected between third and seventh valve means 324 and 344. A fourth flexible conduit 354 is connected between fourth and eighth valve means 326 and 346.

The first, second, third and fourth flexible conduits 348, 350, 352 and 354 and the valve means connected to each of said flexible conduits comprise a means for providing selectable redundant fluid communication between the pressurized fluid discharge of floating vessel 302 and the offshore well 304.

First, second, third and fourth flexible conduits 348, 350, 352 and 354 are all connected to flotation means including a plurality of flotation collars 356 spaced along a length of said flexible conduits.

Figure 7:
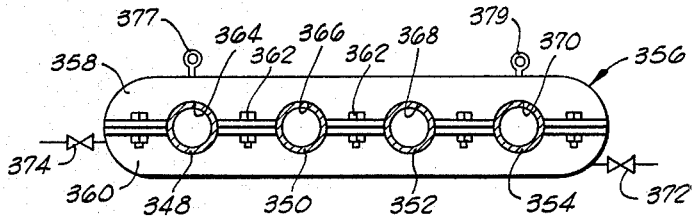
FIG. 7 is a section view along line 7—7 of FIG. 6, illustrating one of the flotation collars.

The details of construction of one flotation collar 356 are shown in FIG. 7. Flotation collars 28 of FIGS. 1 and 2 are constructed similarly to flotation collars 356, but of course, are adapted for carrying only two or three flexible conduits rather than the four flexible conduits shown in FIG. 7.

Each of the flotation collars 356 includes first and second flotation collar halves 358 and 360. The flotation collar halves are connected together by a plurality of suitable fastening means 362.

When connected together, flotation collar halves 358 and 360 form a plurality of cylindrical bores 364, 366, 368 and 370 therethrough.

Flexible conduits 348, 350, 352 and 354 are received within bores 364, 366, 368 and 370, respectively.

First flotation collar half 358 includes a first compartment having a permanent positive buoyancy provided by foam filler located within first flotation collar half 358.

Second flotation collar half 360 includes a second compartment being selectively floodable through valves 372 and 374 to vary the buoyancy of the second compartment located in second flotation collar half 360, so that the flexible conduits connected to the flotation collars 356 may be submerged below the surface of the ocean.

Discharge manifold system 300 includes first and second hawser means 376 and 378, respectively, each of said hawser means having first and second ends 380 and 382 adapted for connection to floating vessel 302 and offshore production platform 306, which may be also described as a support structure of offshore well 304. Middle portions of hawser means 376 and 378 are clipped to hawser clips 377 and 379 on flotation collars 356.

In FIG. 5, the discharge manifold 300 is illustrated as being supported by a crane 384 and cables 386 of offshore production platform 306. In the particular embodiment illustrated in FIG. 5, the hawsers 376 and 378 sometimes will not be needed. The floating vessel 302 would instead be connected to offshore production platform 306 by separate mooring lines.

The discharge manifold system 300 may, however, be used in a manner other than that illustrated in FIG. 5. For example, the second manifold means 328 may be connected to a riser pipe, such as riser pipe 32 shown in FIG. 1 at a location closely adjacent the ocean surface. In that manner of use, the hawsers 376 and 378 would be used to connect floating vessel 302 to offshore production platform 306.

Figure 8:
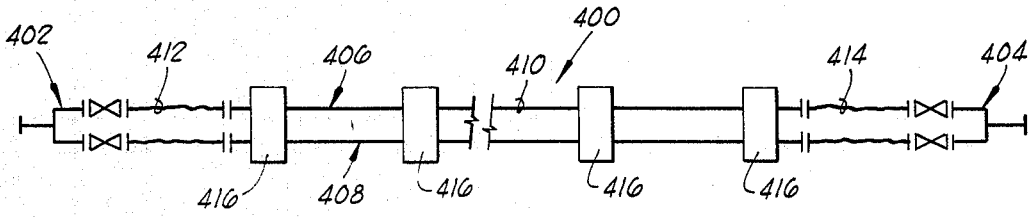
FIG. 8 is a plan view of a discharge manifold system for use without a floating buoy, said system including portions of conventional steel pipe with flexible conduits attached to either end thereof for use instead of entirely flexible conduits.
Figure 5:
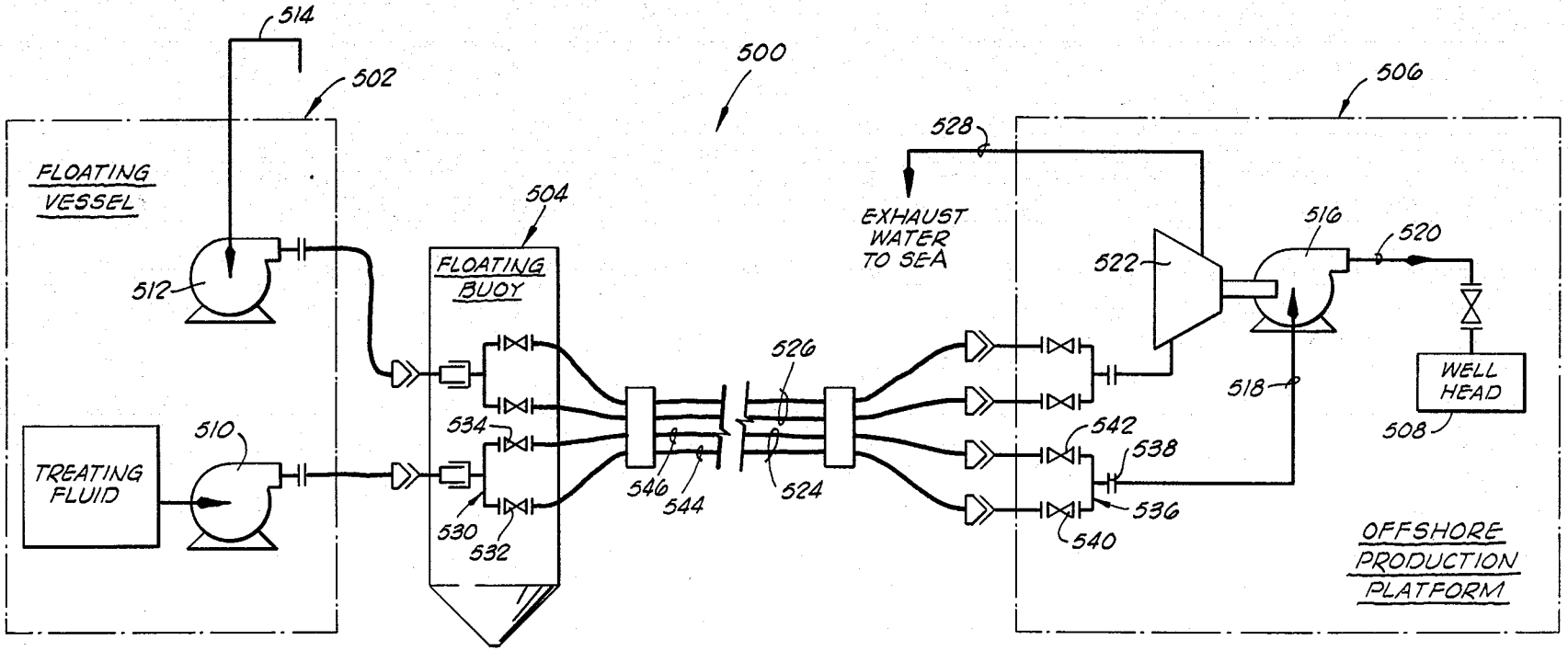

Another version of discharge manifold system similar to that of FIGS. 5 and 6 is shown in FIG. 8 and generally designated by the numeral 400. The discharge manifold system 400 includes first and second manifold means 402 and 404. Connected between those first and second manifold means 402 and 404 are first and second flexible conduit means 406 and 408. The conduit means 406 comprises a middle portion 410 constructed of conventional steel pipe. Connected to first and second ends of middle portion 410 are first and second flexible conduit end portions 412 and 414.

Connected to conduits 406 and 408 are a plurality of spaced flotation collars 416. Flotation collars 416 are constructed in a manner somewhat similar to that of flotation collar 356 shown in FIG. 7.

Referring now to FIG. 9, a schematic illustration is thereshown of a discharge manifold and intensifier system generally designated by the numeral 500. The discharge manifold and intensifier system 500 includes a floating vessel 502, a floating buoy 504 and an offshore production platform 506 adjacent offshore well 508. Again, the offshore well 508 is represented by the well head.

Floating vessel 502 includes a first pump 510 which provides a source of treating fluid under pressure.

Floating vessel 502 also includes a second pump 512 which provides a source of power fluid under pressure. The power fluid provided by pump 512 is sea water drawn in through suction line 514.

Located on offshore platform 506 is an intensifier pump means 516 for increasing the pressure of the treating fluid. Intensifier pump means 516 receives the treating fluid through a suction line 518 and discharges the treating fluid to offshore well 508 through a discharge line 520.

Also located on offshore production platform 506 is an energy conversion means 522, which for example, may be a turbine or could also be a positive displacement type energy conversion means, for using the power fluid from pump 512 to drive intensifier pump means 516.

A first fluid conducting means 524 is connected between first pump 510 and intensifier pump means 516 for conducting treating fluid from first pump 510 to the suction side of intensifier pump means 516.

A second fluid conducting means 526 is connected between second pump 512 and energy conversion means 522 for conducting power fluid from second pump 512 to the energy conversion means 522. The water from the lower pressure side of energy conversion means 522 is exhausted back to the sea through exhaust line 528.

Each of the fluid conducting means 524 and 526 are similarly constructed. Fluid conducting means 524 includes a first manifold means 530 having first and second valve means 532 and 534 connected to the outlets thereof. A second manifold means 536 has an outlet 538 connected to suction line 518 of intensifier pump means 516. Third and fourth valve means 540 and 542 are connected to the inlets of second manifold means 536.

A first flexible conduit 544 is connected between first and third valve means 532 and 540. A second flexible conduit 546 is connected between second and fourth valve means 534 and 542.

The first, second, third and fourth valve means 532, 534, 540 and 542, and first and second flexible conduits 544 and 546, comprise a means for providing selectable redundant fluid communication between first pump 510, which is a source of treating fluid under pressure, and the suction side of intensifier pump means 518.

Manifold means 530 of first fluid conducting means 524, and the adjacent manifold means of second fluid conducting means 526 located on floating buoy 504, are preferably connected to the pumps on floating vessel 502 through fluid conducting swivel means and snap-in connectors as illustrated.

Thus the discharge manifold systems of the present invention are well adapted to attain the ends and advantages mentioned as well as those inherent therein. While presently preferred embodiments of the invention have been described for the purpose of this disclosure, numerous changes in the construction and arrangement of parts can be made by those skilled in the art, which changes are encompassed within the spirit of this invention as defined by the appended claims.

What is claimed is:

1. A discharge manifold system for connecting a pressurized fluid discharge from a floating vessel to an offshore well, comprising:

a floating buoy;

a manifold means, supported by said buoy, said manifold means including an inlet and first and second outlets, each of said outlets being in fluid communication with said inlet;

fluid conducting swivel means connected to said inlet;

flexible discharge conduit means having a first end connected to said pressurized fluid discharge from said floating vessel;

connecting means for connecting a second end of said flexible discharge conduit means to said fluid conducting swivel means, so that said discharge conduit means may pivot about said manifold means;

first and second valve means connected to said first and second outlets, respectively; and first and second flexible intermediate conduits, extending laterally through a body of water from said floating buoy to said offshore well, and having first ends connected to said first and second valve means, respectively, and having second ends connected to said offshore well, so that pressurized fluid for treating said well can flow through said discharge conduit means, then through said fluid conducting swivel means, then through said manifold means, then through said first and second valve means and said first and second intermediate conduits to said well, said first and second valve means and first and second intermediate conduits comprising a means for providing selectable redundant fluid communication between said manifold means and said offshore well.

2. The discharge manifold system of claim 1, wherein said floating buoy includes:

a plurality of selectively floodable compartments; and buoyancy adjustment means for selectively filling and emptying said compartments to vary the buoyancy of said buoy.

3. The discharge manifold system of claim 2, further comprising:

an anchor means, said anchor means including an anchor engaging a floor of said body of water, a winch supported by said buoy, and an anchor line connected between said winch and said anchor, so that a tension load on said anchor line may be varied by reeling said anchor line on said winch.

4. The discharge manifold system of claim 3, further comprising discharge manifold system of claim 3, further comprising:

remote control means for controlling said buoyancy adjustment means and said winch from a position remote from said buoy.

5. The discharge manifold system of claim 4, wherein said floating buoy and said anchor means are so constructed that when said floodable compartments are flooded said winch is capable of pulling said buoy completely under water.

6. The discharge manifold system of claim 1, further comprising:

an anchor means, said anchor means including an anchor engaging a floor of said body of water, a winch supported by said buoy, and an anchor line connected between said winch and said anchor, so that a tension load on said anchor line may be varied by reeling said anchor line on said winch.

7. The discharge manifold system of claim 1, wherein said connecting means comprises:

a snap-in connector including first and second connector portions connected to said flexible discharge conduit means and said fluid conducting swivel means, respectively.

8. The discharge manifold system of claim 7, further comprising:

remote control means for disengaging said snap-in connector in response to a command signal from said floating vessel.

9. The discharge manifold system of claim 1, wherein:

said first and second valve means each include power operators.

10. The discharge manifold system of claim 9, further comprising:

remote control means for actuating said power operators in response to a command signal from said floating vessel.

11. The discharge manifold system of claim 1, further comprising:

flotation means, engaging said first and second intermediate conduits, for supporting said intermediate conduits above a floor of said body of water.

12. The discharge manifold system of claim 11, wherein:

said flotation means includes a plurality of flotation collars attached to said first and second intermediate conduits, said collars being spaced along a length of said intermediate conduits.

13. The discharge manifold system of claim 12, wherein:

each of said flotation collars includes first and second compartments, said first compartment having a permanent positive buoyancy and said second compartment being selectively floodable to vary the buoyancy of said second compartment.

14. The discharge manifold system of claim 1, further comprising:

third valve means connected between said second end of said first flexible intermediate conduit and said offshore well; and fourth valve means connected between said second end of said second flexible intermediate conduit and said offshore well.

15. The discharge manifold system of claim 14, wherein:

each of said third and fourth valve means include power operators.

16. The discharge manifold system of claim 15, further comprising:

remote control means for actuating said power operators on said third and fourth valve means.

17. The discharge manifold system of claim 14, further comprising:

check valve means between said third and fourth valve means and said offshore well.

18. The discharge manifold system of claim 14, wherein:

said second ends of said first and second flexible intermediate conduits are connected to said third and fourth valve means by first and second snap-in connectors, respectively.

19. The discharge manifold system of claim 18, further comprising:

remote control means for disengaging said first and second snap-in connectors in response to a command signal.

20. The discharge manifold system of claim 1, wherein said flexible discharge conduit means comprises:

first and second flexible discharge conduits having first ends thereof connected to said pressurized fluid discharge from said floating vessel.

21. The discharge manifold system of claim 20, wherein said connecting means comprises:

a second manifold means, having first and second inlets and an outlet, said outlet being in fluid communication with each of said first and second inlets, said outlet being connected to said fluid conducting swivel means, said first and second inlets being connected to second ends of said first and second flexible discharge conduits, respectively.

22. The discharge manifold system of claim 21, wherein:

said second ends of said first and second flexible discharge conduits are connected to said first and second inlets, respectively, of said second manifold means, by first and second snap-in connectors.

23. The discharge manifold system of claim 22, further comprising:

remote control means for disengaging said first and second snap-in connectors in response to a command signal from said floating vessel.

24. The discharge manifold system of claim 1, further comprising:

a burner means supported from said floating buoy for burning waste fluids from said offshore well; and a flexible waste return conduit means, having a first end connected to said offshore well for receiving from said offshore well fluid previously conducted to said offshore well through said flexible intermediate conduits, and having a second end connected to said burner means.

25. The discharge manifold system of claim 24, further comprising:

flotation means, engaging said first and second flexible intermediate conduits and said flexible waste return conduit, for supporting said intermediate conduits and said return conduit above a floor of said body of water.

26. The discharge manifold system of claim 25, wherein:

said flotation means includes a plurality of flotation collars attached to said first and second flexible intermediate conduits and said flexible waste return conduit, said collars being spaced along a length of said intermediate conduits and said return conduit.

27. A discharge manifold and intensifier system for conducting a treating fluid from a floating vessel to an offshore well, comprising:

a floating vessel including a source of treating fluid under pressure and a source of power fluid under pressure;

intensifier pump means for increasing the pressure of said treating fluid, said intensifier pump means having a suction for receiving said treating fluid and having a discharge connected to said offshore well, said pump means being supported by a support structure of said offshore well;

energy conversion means for utilizing said power fluid to drive said intensifier pump means, said energy conversion means being supported by said support structure of said offshore well;

first fluid conducting means for conducting said treating fluid from said source thereof on said floating vessel to said suction of said intensifier pump means; and second fluid conducting means for conducting said power fluid from said source thereof on said floating vessel to said energy conversion means.

28. The discharge manifold and intensifier system of claim 27, wherein said first fluid conducting means comprises:

a first manifold means, including an inlet connected to said source of treating fluid under pressure, and including first and second outlets, each of said outlets being in fluid communication with said inlet;

first and second valve means connected to said first and second outlets, respectively, of said first manifold means;

a second manifold means, including an outlet connected to said suction of said intensifier pump means, and including first and second inlets, each of said inlets of said second manifold means being in fluid communication with said outlet of said second manifold means;

third and fourth valve means connected to said first and second inlets, respectively, of said second manifold means;

a first flexible conduit means connected between said first and third valve means; and a second flexible conduit means connected between said second and fourth valve means;

wherein said first, second, third and fourth valve means and said first and second flexible conduit means comprise a means for providing selectable redundant fluid communication between said source of treating fluid under pressure and said suction of said intensifier pump means.

29. A method of transferring fluid under pressure from a floating vessel to an offshore well, said method comprising the steps of:

anchoring a floating buoy at a distance away from said offshore well, said buoy including a manifold means having an inlet and first and second outlets, said inlet having a fluid conducting swivel means connected thereto, said first and second outlets having first and second valve means connected thereto, respectively;

connecting first and second ends of a flexible discharge conduit means to a fluid discharge means of said floating vessel and to said fluid conducting swivel means, respectively;

laying first and second flexible intermediate conduit means between said floating buoy and said offshore well;

connecting said first flexible intermediate conduit means to said first valve means and to said offshore well;

connecting said second flexible intermediate conduit means to said second valve means and to said offshore well; and pumping said fluid from said fluid discharge means of said floating vessel through said flexible discharge conduit means, then through said fluid conducting swivel means, then through at least one of said first and second flexible intermediate conduit means to said offshore well.

30. The method of claim 29, wherein:

said step of pumping is further characterized as initially pumping said fluid concurrently through both of said first and second flexible intermediate conduit means; and said method further comprises the step of closing one of said first and second valve means after failure of one of said first and second flexible intermediate conduit means so that said treating fluid continues to be pumped through the other of said first and second flexible intermediate conduit means after failure of said one of said first and second flexible intermediate conduit means.

31. The method of claim 29, wherein:

said step of anchoring is further characterized as anchoring said floating buoy at a distance greater than a length of said floating vessel away from said offshore well; and said method further comprises a step of submerging said first and second flexible intermediate conduit means to a depth below a bottom of said floating vessel, so that said floating vessel may rotate 360° about said floating buoy to position itself most favorably relative to oncoming seas during said pumping step.

* * * * *

UNITED STATES PATENT AND TRADEMARK OFFICE

CERTIFICATE OF CORRECTION

PATENT NO. : 4,339,002

DATED : July 13, 1982

INVENTOR(S) : Max A. Gibbs

It is certified that error appears in the above-identified patent and that said Letters Patent are hereby corrected as shown below:

Column 2, line 2 - delete "saves" and insert --waves--.

Column 13, lines 29 and 30 - delete "discharge manifold system of claim 3, further comprising".

Signed and Sealed this

*Twenty-first* Day of *September 1982*

[SEAL]

*Attest:*

GERALD J. MOSSINGHOFF

*Attesting Officer*

*Commissioner of Patents and Trademarks*